US007494295B2

(12) United States Patent
Delage

(10) Patent No.: US 7,494,295 B2
(45) Date of Patent: Feb. 24, 2009

(54) PACKAGING AND APPLICATOR DEVICE

(75) Inventor: Jean-Francois Delage, Clamart (FR)

(73) Assignee: L'Oreal, Paris (FR)

( * ) Notice: Subject to any disclaimer, the term of this patent is extended or adjusted under 35 U.S.C. 154(b) by 467 days.

(21) Appl. No.: 11/192,035

(22) Filed: Jul. 29, 2005

(65) Prior Publication Data

US 2006/0051153 A1 Mar. 9, 2006

Related U.S. Application Data

(60) Provisional application No. 60/601,606, filed on Aug. 16, 2004.

(30) Foreign Application Priority Data

Jul. 30, 2004 (FR) ..... 04 51749

(51) Int. Cl.
*A45D 33/00* (2006.01)
*A46B 11/00* (2006.01)

(52) U.S. Cl. ..... 401/130; 401/126; 401/5

(58) Field of Classification Search ..... 401/119, 401/126, 130, 122, 127, 128, 129, 25; 132/317
See application file for complete search history.

(56) References Cited

U.S. PATENT DOCUMENTS

| | | | | |
|---|---|---|---|---|
| 4,674,903 A | | 6/1987 | Chen | |
| 5,107,870 A | * | 4/1992 | Beck et al. | 132/218 |
| 5,620,270 A | | 4/1997 | Gueret | |
| 5,730,644 A | * | 3/1998 | Pfanstiehl | 451/28 |
| 5,794,632 A | * | 8/1998 | Gueret | 132/317 |
| 2001/0031171 A1 | * | 10/2001 | Delage | 401/205 |
| 2002/0127046 A1 | | 9/2002 | Gueret | |

FOREIGN PATENT DOCUMENTS

| | | |
|---|---|---|
| EP | 0 154 231 A2 | 9/1985 |
| EP | 1 249 187 A1 | 10/2002 |
| EP | 1 382 541 A1 | 1/2004 |
| EP | 1 430 806 A1 | 6/2004 |
| FR | 2 588 457 | 4/1987 |
| FR | 2 823 726 | 10/2002 |
| FR | 2 833 245 | 6/2003 |
| FR | 2 837 678 | 10/2003 |
| JP | A 2002-85151 | 3/2002 |

* cited by examiner

*Primary Examiner*—David J Walczak
(74) *Attorney, Agent, or Firm*—Oliff & Berridge, PLC

(57) ABSTRACT

A device for packaging and applying a substance may include a receptacle containing a supply of the substance, a first applicator element configured to be filled with the substance from the receptacle, and a second applicator element configured to be separated from the receptacle, configured to come into contact with a region to be treated, and configured to at least one of spread out and blend in the substance from the first applicator element. The second applicator element may surround the first applicator element at least in part, at least while the second applicator element is secured to the receptacle.

30 Claims, 6 Drawing Sheets

Fig.5
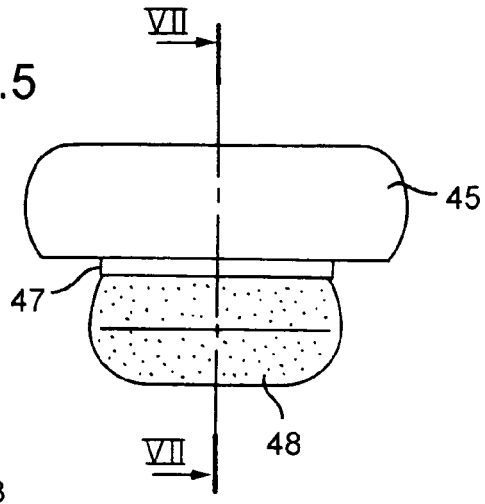
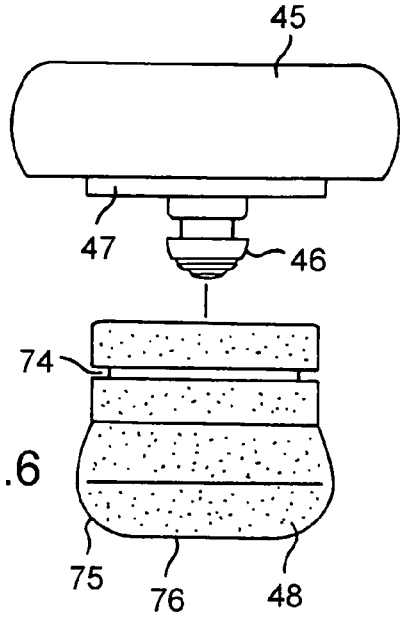
Fig.6
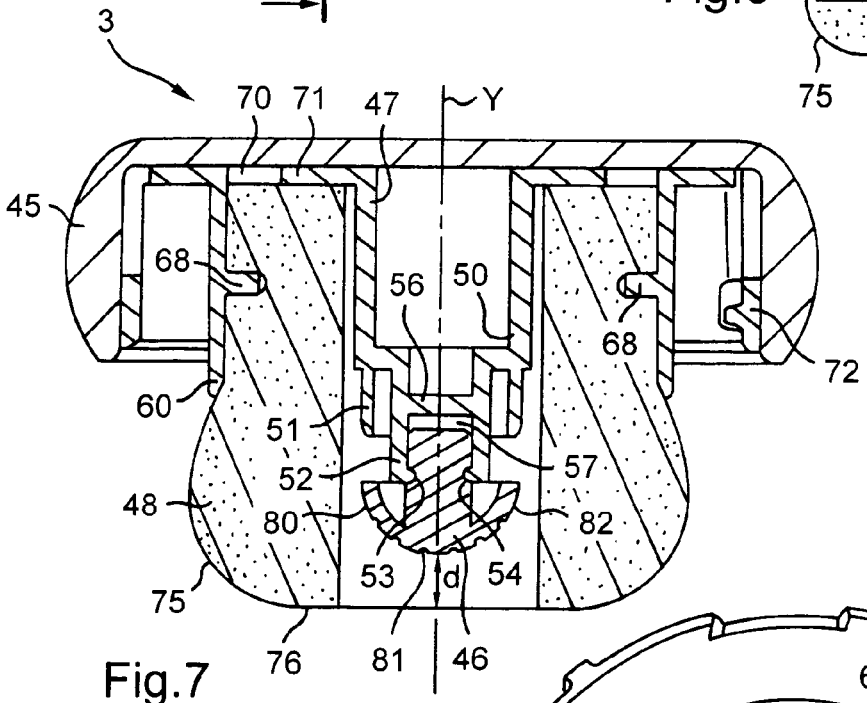
Fig.7
Fig.8
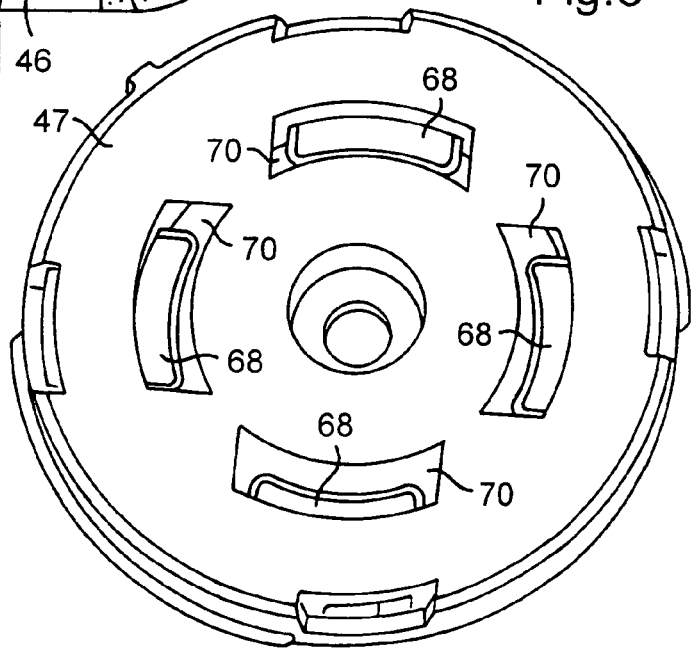

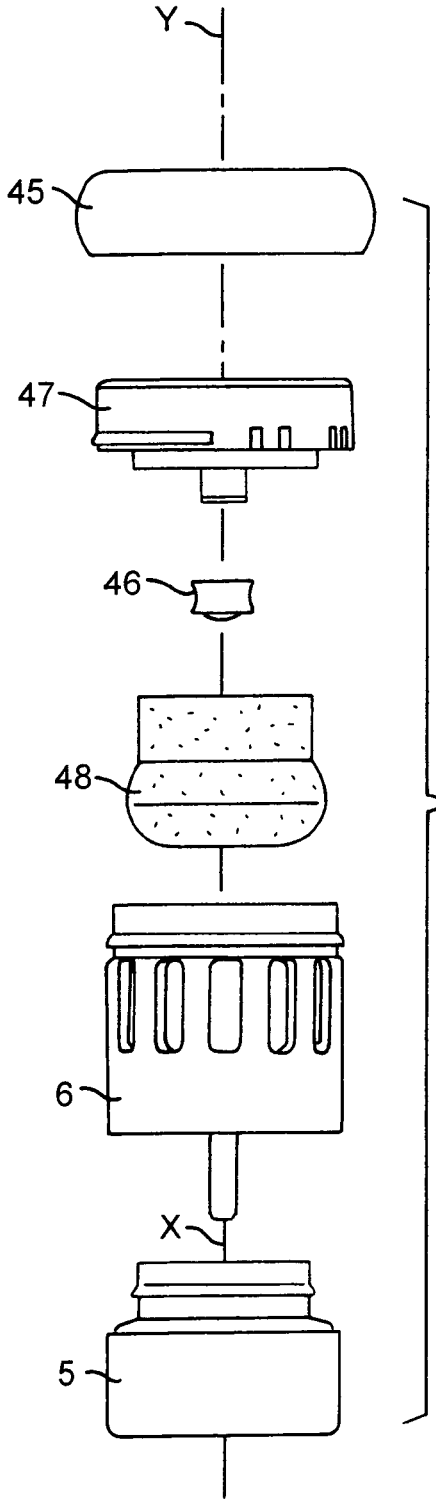
Fig.13
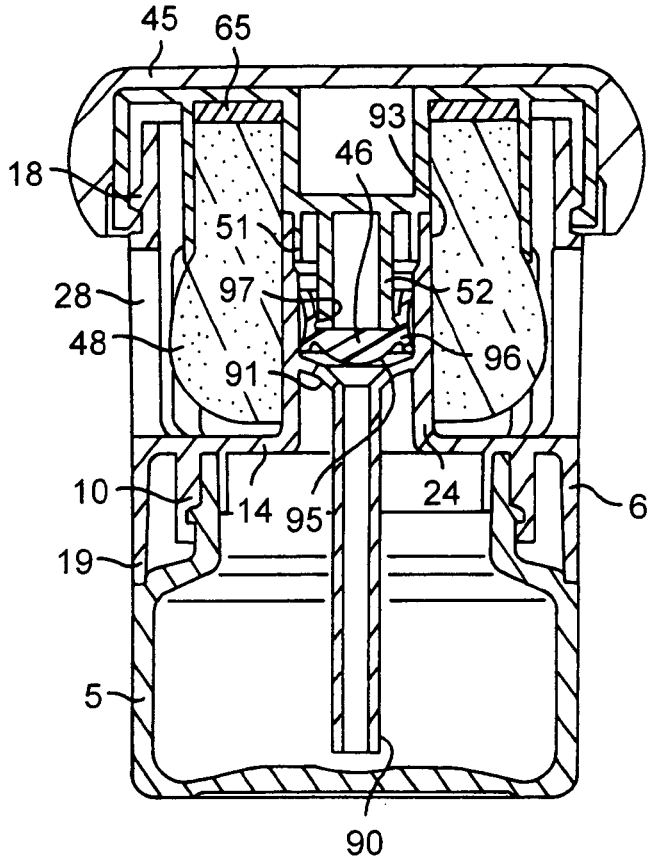
Fig.14
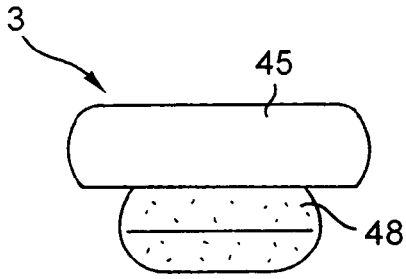
Fig.21
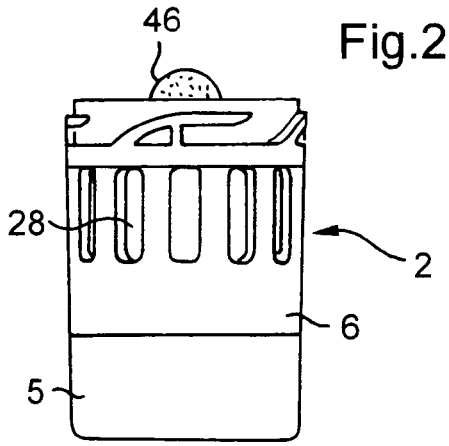

PACKAGING AND APPLICATOR DEVICE

This non-provisional application claims the benefit of French Application No. 04 51749 filed on Jul. 30, 2004, and U.S. Provisional Application No. 60/601,606 filed on Aug. 16, 2004, the entire disclosures of which are incorporated herein by reference.

The present invention relates to devices for packaging and applying a substance, for example, a cosmetic or another care product.

BACKGROUND

French patent application FR 2 833 245 discloses an assembly for applying a substance comprising an applicator completely or partially surrounding a substance in the form of a stick mounted on a carrier element that is movable relative to the applicator.

French patent application FR 2 823 726 discloses an assembly for packaging and applying a substance, the assembly having an applicator member carried by an element for closing a receptacle, which itself has a housing suitable for receiving the applicator element when the receptacle is closed. In such a device, the applicator element is isolated from ambient air when the receptacle is closed.

French patent application FR 2 588 457 discloses a makeup remover device having a reservoir and an applicator element with a central tube passing therethrough. U.S. Pat. No. 4,674,903 discloses a similar device.

European patent application EP 1 382 541 A1 discloses a packaging and applicator device comprising a receptacle fitted with a first applicator element and a receptacle closure member that is capable of containing a second applicator element. For example, the second applicator element is contained in a housing closable by a hinged lid.

U.S. Pat. No. 5,620,270 discloses an assembly for applying a substance comprising two applicators fitted one behind the other and dedicated to applying a makeup product on eyelashes.

EP-A2-0154 231 discloses a packaging and applicator device comprising a foam and tufts of bristle or ropes positioned around the foam, fastened to the receptacle containing the product, and used altogether.

SUMMARY

Exemplary embodiments of the invention seek to further improve devices for packaging and applying a substance.

Exemplary embodiments of the invention provide a device for packaging and applying a substance, for example, a substance that is to be applied to skin, mucous membranes such as lips, or nails, the device comprising: a receptacle containing a supply of the substance; a first applicator element that configured to be refilled with substance, configured to be filled with the substance from the receptacle; and a second applicator element configured to be separated from the receptacle, configured to come into contact with a region to be treated, and configured to, for example, spread out or blend in the substance from the first applicator element, the second applicator element surrounding the first applicator element at least in part, at least when the second applicator element is secured to the receptacle. For example, the first and second applicator elements may be disposed concentrically, at least when the second applicator element is secured to the receptacle. The second applicator element may be secured to a member for closing the receptacle.

In the description and the claims, the term "first applicator element" should be understood broadly and covers an element that may optionally come into contact with the region to be treated during application of the substance. Application may thus be direct or indirect, possibly taking place via the second applicator element.

In various exemplary embodiments, by using the second applicator element, a user may touch up makeup without fear of applying too much substance. The fact that the second applicator element surrounds the first, at least in part, at least when the second applicator element is secured to the receptacle, may increase compactness.

In exemplary embodiments, the substance may be a fluid or a powder, for example, a foundation.

In exemplary embodiments, the second applicator element may be in communication with ambient air when the receptacle is closed.

In exemplary embodiments, the receptacle may comprise at least one passage allowing the second applicator element to communicate with ambient air when the receptacle is closed. For example, the receptacle may comprise a perforated wall surrounding the second applicator element, at least in part, when the receptacle is closed.

Thus, for example, in such embodiments, the second applicator element may dry out when not in use, thereby limiting any risk of microbiological proliferation, thus making it possible, for example, to reduce a quantity of preservatives in the substance or a quantity of biocidal agents incorporated in the second applicator element, for example, when the second applicator element is made of a material that is cellular and/or porous. Such embodiments may also improve blending, since it is generally easier to blend with an applicator element that is dry than with an applicator element that is full of substance.

In exemplary embodiments, the second applicator element may be secured to a closure member of the receptacle. The closure member may be configured to co-operate with the receptacle in such a manner as to prevent communication between the second applicator element and the supply of substance when the receptacle is closed.

In exemplary embodiments, the first and second applicator elements may be secured to each other while in use. The second applicator element may, for example, surround at least part of the first applicator element.

In exemplary embodiments, the second applicator element need make no contact with the first applicator element.

In exemplary embodiments, the second applicator element may be compressible, for example, comprising a foam, such as a foam with a hollowed-out center, making it possible, for example, to receive the first applicator element, at least in part, in the hollowed-out center.

In exemplary embodiments, the receptacle may comprise a housing configured to receive the second applicator element when the receptacle is closed. The housing may communicate with the supply of substance.

In exemplary embodiments, the first applicator element need not be in contact with the region being treated while the device is in use, so long as the second applicator element is not compressed.

In exemplary embodiments, the first applicator element may comprise a flexible endpiece, for example, an endpiece made of elastomer or foam. The first applicator element may comprise at least one cavity for retaining the substance.

In exemplary embodiments in which the first applicator element is separable from the receptacle, the first applicator element may be configured to act as a piston in a housing of the receptacle on being separated from the receptacle. For example, the receptacle may comprise a dip tube in communication with the housing. The first applicator element may comprise a sealing lip configured to press against a wall of the housing.

In exemplary embodiments, the first applicator element may comprise a tube configured to be filled at least in part with the substance. The tube may be connected to a cavity of variable volume, which may be defined at least in part by a flexible wall configured to be pressed by a user. The flexible wall may be provided, for example, on a handle member of the applicator.

In exemplary embodiments, the receptacle may comprise an endpiece in communication with a dip tube in which the first applicator element is configured to engage in a substantially leaktight manner so as to suck the substance from the receptacle.

In exemplary embodiments, the first applicator element and the endpiece may be advantageously arranged to cooperate in a substantially leaktight manner before the closure member of the receptacle becomes fully fastened thereon.

In exemplary embodiments, the first applicator element may also be secured to the receptacle while in use.

Exemplary embodiments of the invention provide a method of applying makeup, for example, to skin, mucous membranes such as lips, or nails, using a device as defined above. In exemplary embodiments, the first applicator element may be filled with the substance from the receptacle, the substance on the first applicator element may then be released, and the second applicator element may be used to spread out or to blend in the released substance over the region to be treated. The substance on the first applicator element may be released directly onto the region to be treated or may initially be released onto the second applicator element.

Exemplary embodiments of the invention provide, independently or in combination with the above, a device for packaging and applying a substance, the device comprising: a receptacle containing a supply of the substance; a first applicator element configured to be filled with the substance from the receptacle; and a second applicator element configured to be separated from the receptacle, configured to come into contact with a region to be treated, and configured, for example, to spread out or to blend in the substance from the first applicator element. The receptacle may comprise a perforated wall surrounding the second applicator element, at least in part, and may include at least one opening allowing the second applicator element to communicate with ambient air when the receptacle is closed. In such exemplary embodiments, the second applicator element may dry out when not in use, thereby providing one or more of the above-mentioned advantages.

Exemplary embodiments of the invention provide, independently or in combination with the above, a device for packaging and applying a substance on skin, mucous membranes such as lips, or nails, the device comprising: a receptacle containing a supply of the substance; a first applicator element configured to be filled with the substance from the receptacle; and a second applicator element configured to be separated from the receptacle, configured to come into contact with a region to be treated, and configured, for example, to spread out or to blend in the substance from the first applicator element. The first and second applicator elements may be disposed substantially on one side of a handle member of the device. The first and second applicator elements may be disposed substantially on a same side of the handle member, at least while each of the applicator elements is in use. The second applicator element may be secured to a closure member of the receptacle. A user may thus easily use, or not use, one of the applicator elements, for example, by exerting more or less pressure on the region to be treated or by pointing the handle member suitably.

Exemplary embodiments of the invention provide, independently or in combination with the above, a device for packaging and applying a substance, the device comprising: a receptacle containing a supply of the substance; a first applicator element configured to be filled with the substance from the receptacle, and configured to be separated therefrom; and a second applicator element configured to be separated from the receptacle, configured to come into contact with the region to be treated, and configured, for example, to spread out or to blend in the substance from the first applicator element. The first applicator element may be configured to act as a piston in a housing of the receptacle when the first applicator element is moved relative to the receptacle. Such exemplary embodiments may make it easier, for example, to fill the first applicator element with substance.

Exemplary embodiments of the invention provide, independently or in combination with the above, a device for packaging and applying a substance, the device comprising: a receptacle containing a supply of the substance; a first applicator element configured to be filled with the substance from the receptacle; and a second applicator element configured to be separated from the receptacle, configured to come into contact with a region to be treated, and configured to spread out or to blend in the substance from the first applicator element. The first applicator element may comprise a tube configured to be filled at least in part with substance. For example, such exemplary embodiments may enable a user to measure out more accurately a quantity of substance that is to be used for application. Where appropriate or desired, such exemplary embodiments may make it possible for the first applicator element to be used for longer between refills.

BRIEF DESCRIPTION OF THE DRAWINGS

The invention may be better understood on reading the following detailed description of non-limiting embodiments thereof, and on examining the accompanying drawings, in which:

FIG. 5 shows another exemplary embodiment of an applicator, in elevation and in isolation;

FIG. 6 is an exploded view of the applicator of FIG. 5;

FIG. 7 is a diagrammatic axial cross-sectional view taken along VII-VII of FIG. 5;

FIG. 8 shows a support part of the second applicator element of the applicator of FIG. 5, in isolation;

FIG. 13 is an exploded view of another exemplary embodiment;

FIG. 14 is an axial cross-sectional view of the device of FIG. 13;

FIG. 21 is a diagrammatic elevation view of another exemplary embodiment.

DETAILED DESCRIPTION OF EMBODIMENTS

Figure 1:
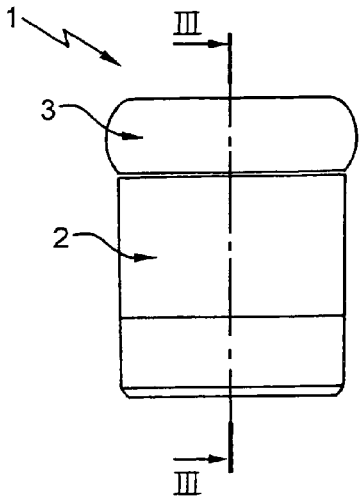
FIG. 1 is a diagrammatic elevation view of an exemplary embodiment of a packaging and applicator device.

The exemplary packaging and applicator device 1 shown in FIG. 1 may comprise a receptacle 2 and an applicator 3 configured to be separated from the receptacle 2 when in use.

Figure 2:
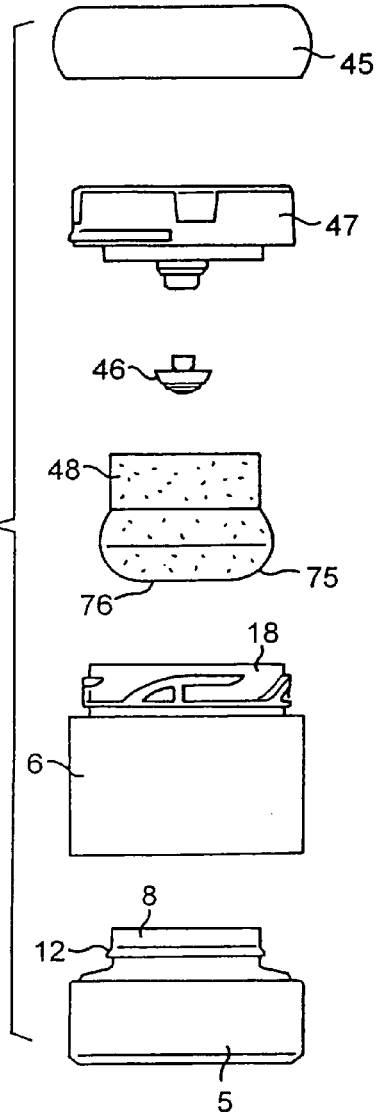
FIG. 2 is an exploded view of the device of FIG. 1.
Figure 3:
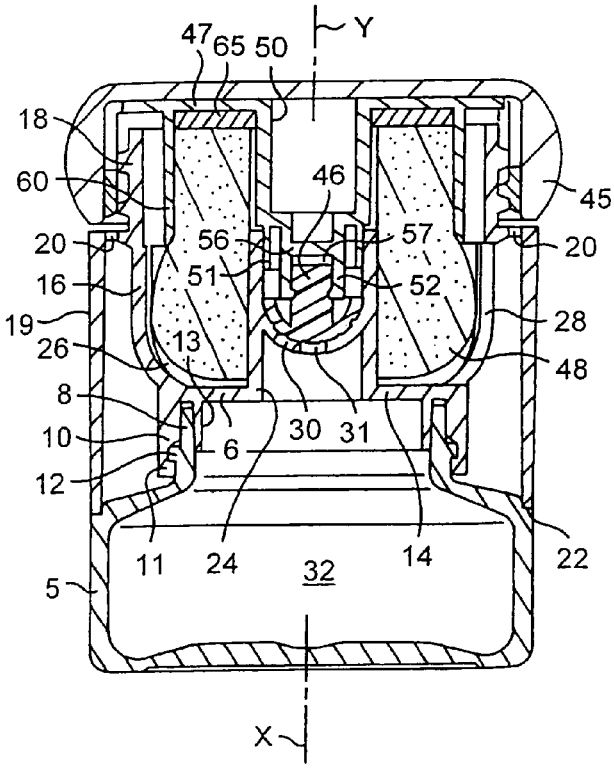
FIG. 3 is a diagrammatic axial cross-sectional view taken along III-III of FIG. 1.

As shown, for example, in FIGS. 2 and 3, the receptacle 2 may comprise a bottom portion 5 and a top portion 6 assembled on the bottom portion 5.

In the exemplary embodiment shown, the bottom portion 5 may comprise a flask with a neck 8 of axis X. The top portion 6 may include an assembly skirt 10 provided with teeth 11 that snap onto a bead 12 on the neck 8, and an annular sealing lip 13 pressing against a radially inner surface of the neck 8. The assembly skirt 10 and the sealing lip 13 may include top ends thereof connected to a transverse wall 14.

The top portion 6 may include a perforated wall 16 that is connected at a bottom end thereof to the transverse wall 14, at a periphery thereof. The perforated wall 16 may be extended upward by a threaded portion 18. A covering skirt 19 may be connected at a top end thereof to the threaded portion 18 via bridges of material 20, and a bottom end thereof may come to bear against a shoulder 22 of the flask 5.

Figure 4:
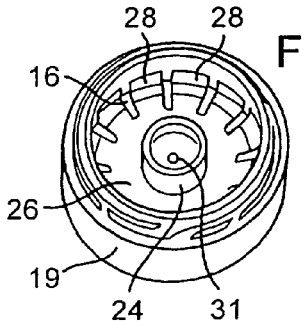
FIG. 4 shows a top portion of receptacle of FIG. 1, in perspective and in isolation.
Figure 9:
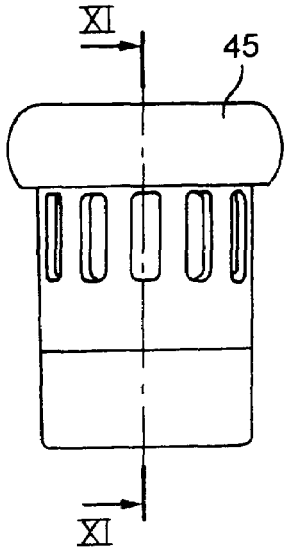
FIG. 9 is a view analogous to FIG. 1, showing another exemplary embodiment.
Figure 10:
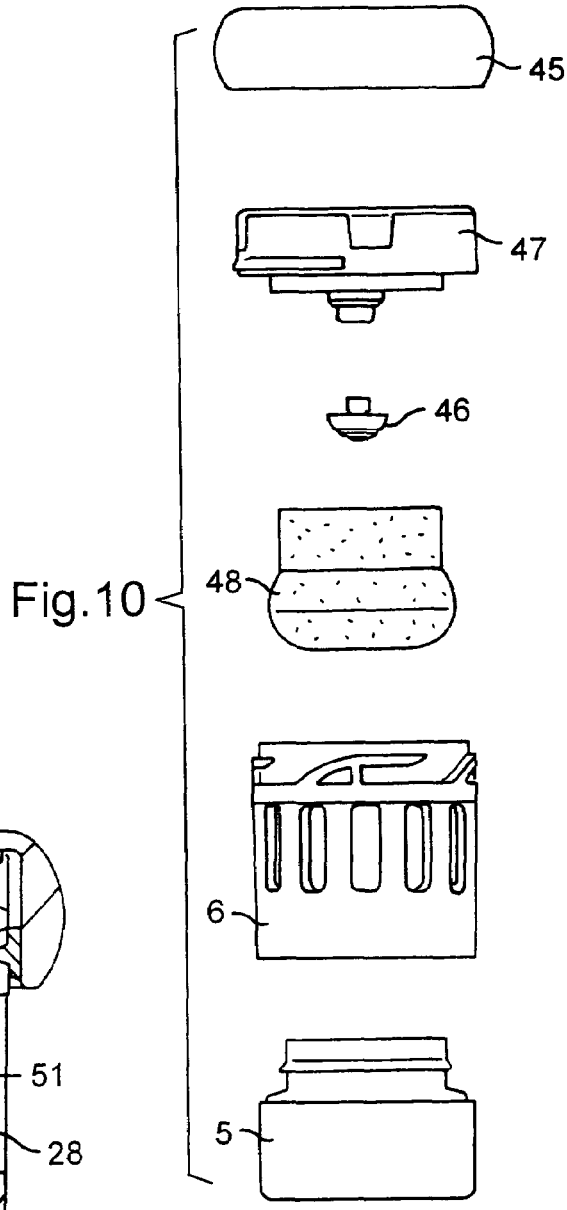
FIG. 10 is an exploded view of the device of FIG. 9.

The top portion 6 may also include a chimney 24 of axis X with a bottom end thereof connected to the transverse wall 14 and co-operating with the perforated wall 16 to define a housing 26 that may communicate with ambient air, following a path that passes via an opening 28 in the perforated wall 16 (as shown in FIG. 4), and then via gaps that exist between the bridges of material 20 that connect the threaded portion 18 to the covering skirt 19.

The chimney 24 may define a housing including an upwardly concave bottom wall 30 that extends inside the chimney 24, the wall 30 being pierced at a center thereof by an orifice 31 opening into an inside space 32 of the receptacle, that is to receive the substance.

As shown, for example, in FIGS. 2 and 3, the applicator 3 may comprise a handle portion 45, a first applicator element 46, a second applicator element 48, and a support part 47 for the applicator elements. In the exemplary embodiment, the first and second applicator elements may be other than a comb or a brush for eyelashes or eyebrows.

In the exemplary embodiment described, the support part 47 may include a central chimney 50 of axis Y that coincides with the axis X when the applicator 3 is in place on the receptacle 2.

The chimney 50 may carry an annular sealing lip 51 configured to press against an inside surface of the chimney 24 when the receptacle 2 is closed, as shown in FIG. 3, and a portion 52 configured to hold the first applicator element 46, for example, comprising a shape in relief 53 engaged in a corresponding groove 54 of the first applicator element 46.

For example, the shape in relief 53 may comprise an annular bead projecting radially inward from the bottom end of the holding portion 52. The holding portion may also include a transverse wall 56 that closes a top of the housing 57 in which a top of the first applicator element 46 may be engaged.

The support part 47 may comprise a tubular skirt 60 of axis Y that co-operates with the chimney 50 to define an annular groove around the chimney in which the top of the second applicator element 48 may be received. In the exemplary embodiment of FIG. 3, the second applicator element 48 may comprise a block of foam that is hollowed out internally and secured in a bottom of the groove by a layer of adhesive 65.

In the exemplary embodiment of FIGS. 5 to 8, the tubular skirt 60 may include teeth 68 substantially halfway up a height thereof, which may engage in an annular groove 74 in the second applicator element 48. As shown in FIGS. 7 and 8, openings 70 may be provided in a top wall 71 of the support part 47 for the purpose of making it possible to mold the teeth 68.

The support part 47 may include a radially outer skirt 72 with an inside thread that enables the applicator 3 to be screwed onto the receptacle 2.

The handle portion 45 may be secured to the support part 47, in various ways, onto the skirt 72, for example, by snap-fastening as in the exemplary embodiment shown, or by an adhesive, or in some other way.

The portion of the second applicator element 48 that extends outside the tubular skirt 60 may include a side face 75 that is generally rounded and outwardly convex, and an end face 76 that is substantially planar, perpendicular to the axis Y, and annular in shape.

The first applicator element 46 may include an outside face 80 that is generally downwardly convex in the exemplary embodiment shown, with cavities 81 serving to retain the substance. The face 80 may be upwardly defined by a flexible upwardly-directed annular lip 82.

When the applicator 3 is separated from the receptacle 2, and while the applicator 3 is not being pressed against the region to be treated, the face 80 may be situated at a non-zero distance d from the plane of the end face 76. Thus, in use, and so long as the second applicator element 48 is not compressed, the first applicator element 46 may remain set back from the region being treated.

To use the device 1, the user may proceed as follows.

Firstly, the substance contained in the inside space 32 of the receptacle 2 may be taken using the first applicator element 46, for example, either by turning the receptacle upside-down so that the substance flows under gravity through the orifice 31 in the end wall 30 and reaches the first applicator element 46, or by shaking the receptacle.

Thereafter, the user may separate the applicator 3 from the receptacle 2, with a certain quantity of substance on the first applicator element 46, for example, in the cavities 81.

The user may then bring the applicator 3 into contact with a region to be treated, for example, skin of the face or the body, and compress the second applicator element 48 sufficiently to enable the first applicator element 46 to deposit the substance on the region to be treated.

Thereafter, the user may make use of the applicator element 48 to spread out the substance that has been deposited, and/or to blend such substance in, by exerting pressure on the applicator 3 gently enough to ensure that only the second applicator element 48 comes into contact with the region to be treated.

The exemplary embodiment shown in FIGS. 9 to 12 differs from the exemplary embodiment of FIG. 3 in a shape of the top portion 6 of the receptacle, the covering skirt 19 being connected at a top end thereof to the transverse wall 14, and the perforated wall 16 extending the covering skirt 19 between the skirt and the threaded portion 18.

The openings 28 may open firstly to the outside and secondly directly in registration with the second applicator element 48.

In at least one plane perpendicular to the axis Y, the openings 28 may occupy at least one-fourth of a total circumference of the perforated wall 16, for example, or even at least half.

The exemplary embodiment of FIGS. 13 and 14 differs from the above-described exemplary embodiments in the way in which the substance is taken from the receptacle 2 to fill the first applicator element 46.

The top portion 6 of the receptacle 2 in this exemplary embodiment may include a dip tube 90 that extends down practically to a bottom of the flask 5 and that is connected via a flared wall 91 to the chimney 24, instead of and replacing the end wall 30.

Figure 11:
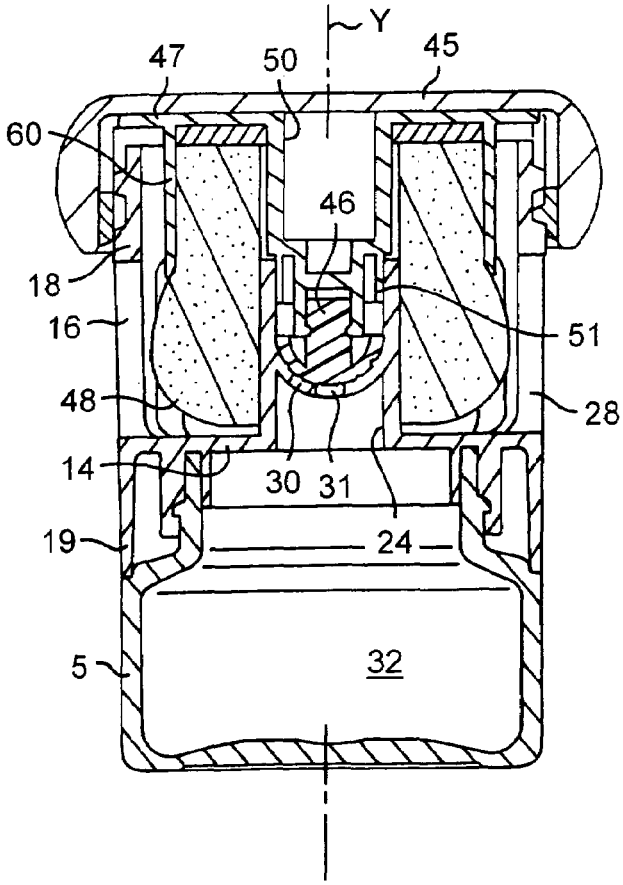
FIG. 11 is a diagrammatic axial cross-sectional view taken along XI-XI of FIG. 9.
Figure 12:
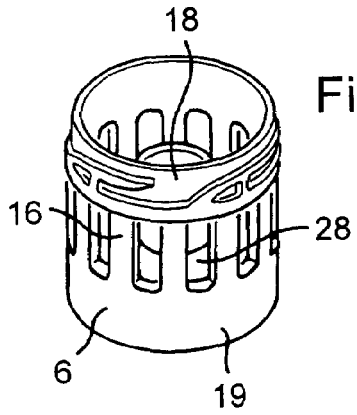
FIG. 12 shows a top portion of the receptacle of FIG. 9, in perspective and in isolation.

The chimney 24 differs from that shown in FIG. 11 in a shape of a top portion thereof, which is narrowed in the exemplary embodiment of FIG. 14, forming an annular surface 93 that is radially set back and against which the sealing lip 51 of the applicator 3 may bear when the applicator is in place on the receptacle.

A shape of the holding piece 52 may also be different, as may be a shape of the first applicator element 46. The first applicator element 46 may include a bottom face 95 that is downwardly convex, and at a periphery thereof, may include two sealing lips 96 of outwardly concave arcuate shape that may press via top and bottom edges against the radially inner surface of the chimney 24, above the flared wall 91.

For example, the first applicator element 46 may be secured to the holding piece 52 by one or more shapes in relief 97 carried by a top portion of the sealing lip 96.

Figure 17:
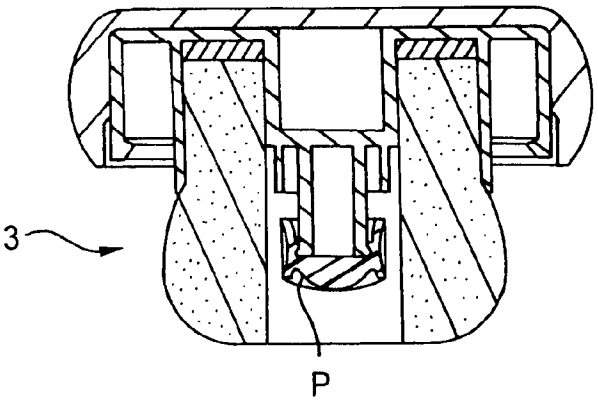
FIGS. 15 to 17 illustrate exemplary operation of the device of FIG. 14.
Figure 16:
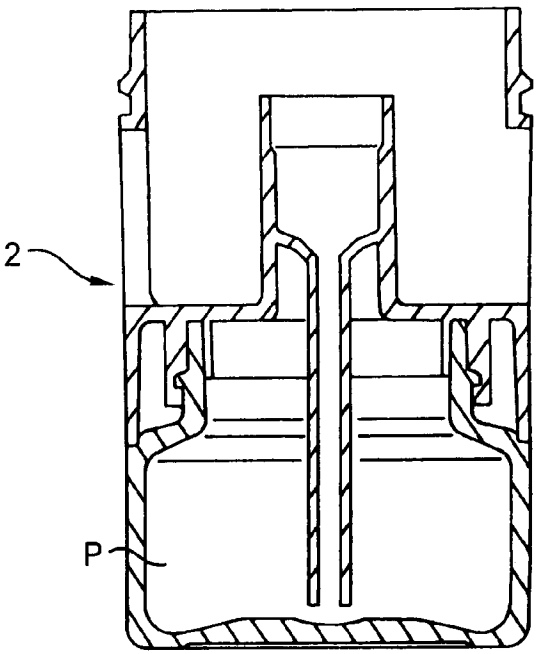
Figure 16:
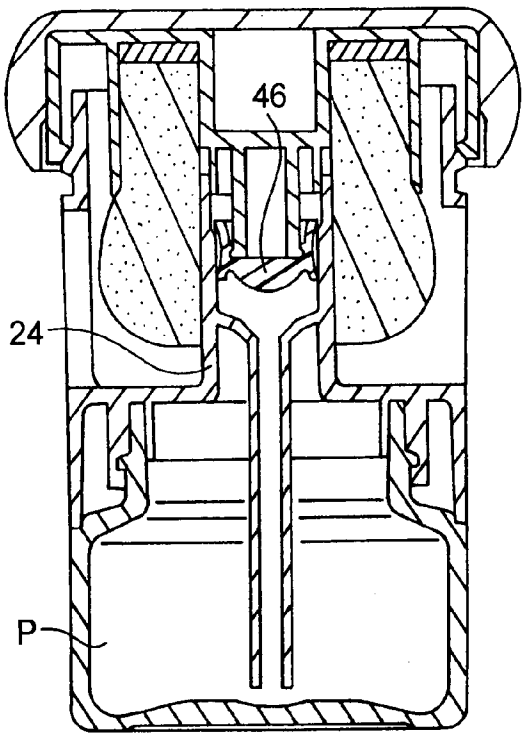
Figure 15:
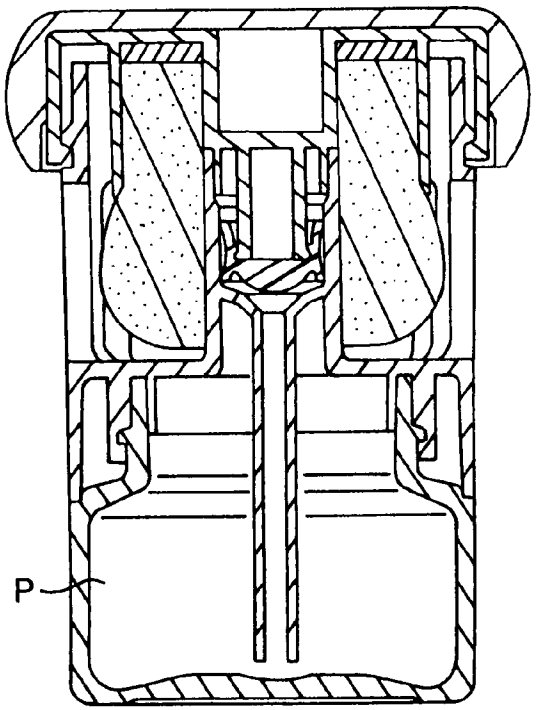

Because of the sealing lip 96, the first applicator element 46 may behaves as a piston in the housing formed inside the chimney 24, such that when the applicator 3 is unscrewed, as shown in FIGS. 15 and 16, substance may tend to be sucked into the inside of the chimney 24 by the first applicator element 46 rising. Thus, the first applicator element 46 may become filled with substance P on being fully separated from the receptacle 2, as shown in FIG. 17, without there being any need to shake the receptacle or turn the receptacle upside-down.

Figure 18:
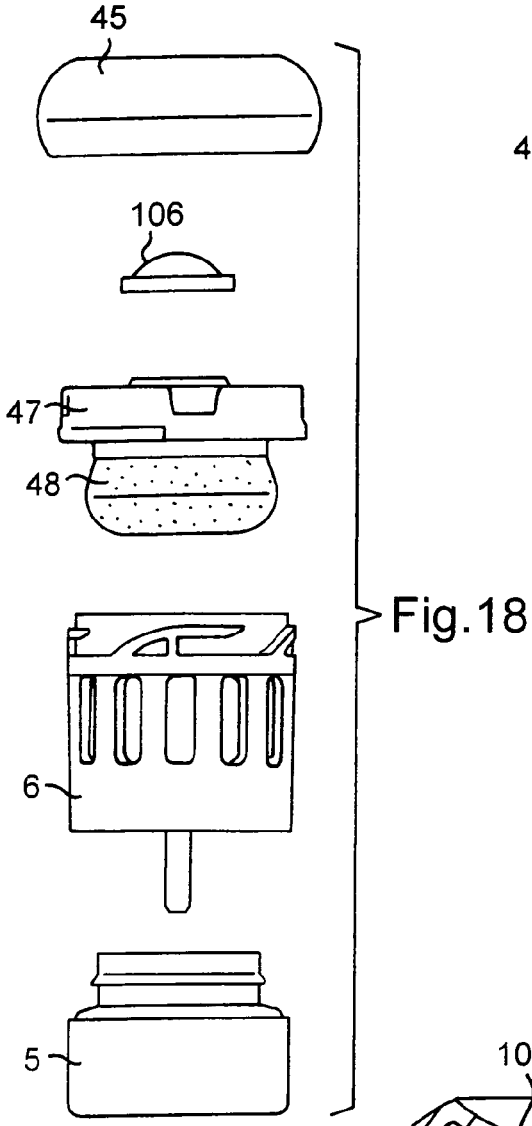
FIG. 18 is an exploded view of another exemplary embodiment.
Figure 19:
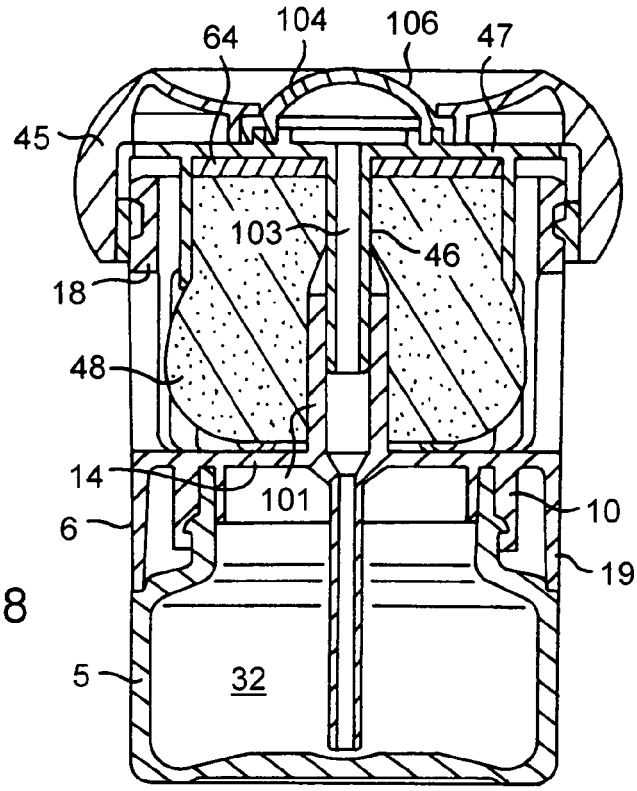
FIG. 19 is a diagrammatic axial cross-sectional view of the device of FIG. 18.

In the exemplary embodiment FIGS. 18 and 19, the top portion 6 of the receptacle may include a dip tube 100 that extends substantially down to the bottom of the flask 5 and that is connected at a top end thereof to an endpiece 101 carried by the transverse wall 14.

The endpiece 101 may include an inside diameter that matches that of the first applicator element 46, which may be formed by a tube in this exemplary embodiment. The tube may include an internal channel 103 that opens at a top end thereof into a cavity 104 of variable volume, formed between the support part 47 and a flexible wall 106 of bulging shape, against which the user may press. The flexible wall 106 may project from a setback 108 in a top of the handle portion 45.

In the exemplary embodiment described, the flexible wall 106 may be secured to the transverse wall 71 of the support part 47 by tightening a peripheral portion 110 that is provided with an annular groove 111 between the handle portion 45 and the support part 47. The support part 47 may include a first annular rib 112 engaging in the groove 111. The groove 111 may be formed between two ribs, one of which may be engaged in a corresponding groove 113 formed between the first annular rib 112 and a second rib 114, concentric with the first rib 112.

In this exemplary embodiment, the first applicator element 46 may be molded integrally, i.e., monolithically, with the support part 47.

When the applicator 3 is in place on the receptacle 2, the first applicator element 46 may be engaged in the endpiece 101 in a substantially leaktight manner, for example, to substantially halfway up a height thereof.

When the user presses on the flexible wall 106 and then releases the flexible wall 106, suction may be established in the channel 103 causing the substance to rise therein.

Given the lengths of the endpiece 101 and the first applicator element 46 that overlap, the applicator 3 does not need to be pressed home on the receptacle 2 to allow the user to engage the first applicator element 46 in a sufficiently leaktight manner in the endpiece 101 to be able to suck up the substance.

Once the applicator 3 has been separated from the receptacle, by pressing on the flexible wall 106, the user may cause the substance to be delivered from the first applicator element 46 and be deposited onto the second applicator element 48, and may then apply the substance using the second applicator element 48.

In another exemplary embodiment, once the channel 103 is at least partially filled with substance, the user may deposit the substance directly on the region to be treated, for example, by compressing the second applicator element 48 until the end of the first applicator element 46 is brought into contact with the region being treated, and then by pressing on the flexible wall 106 may expel the substance onto the region being treated.

Naturally, the invention is not limited to the exemplary embodiments described above.

Figure 20:
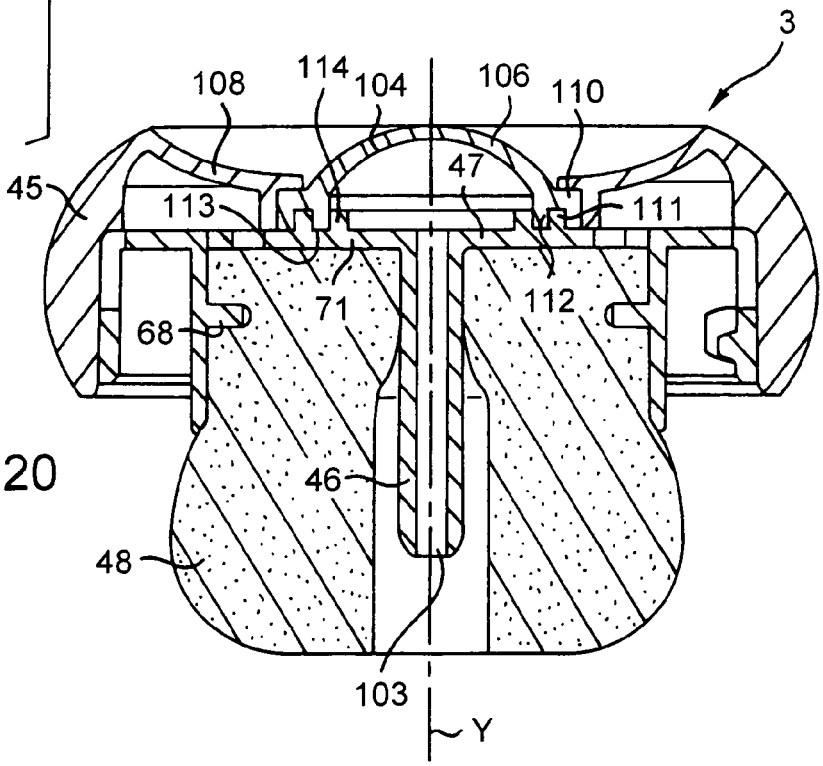
FIG. 20 is a diagrammatic axial cross-sectional view of another exemplary embodiment of the applicator of FIG. 19, shown in isolation.

For example, the various exemplary embodiments may be combined with one another. For example, the second applicator element 48 may be secured to the applicator 3 in some other way, such as with teeth 68 as shown in FIG. 20.

The first applicator element and the top portion of the receptacle may also be made differently, for example, as a function of a nature of the substance and the region to be treated.

The top and bottom portions of the receptacle may be made integrally as a single piece or by assembling together a plurality of parts.

The first applicator element 46 may also be carried on the receptacle 2, as shown in FIG. 21. In such embodiments, the applicator 3 may include only the second applicator element 48. The applicator element 46 may comprise, for example, a porous material fed from the substance-containing inside space of the receptacle.

When the applicator 3 is in place on the receptacle, the first applicator element 46 may be received in the hollow in the second applicator element.

Throughout the description, including in the claims, the term "comprising a" should be understood as being synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A device for packaging and applying a substance, the device comprising:

a receptacle containing a supply of the substance;

a first applicator element configured to be filled with the substance from the receptacle; and a second applicator element configured to be separated from the receptacle, configured to come into contact with a region to be treated, and configured to at least one of spread out and blend in the substance from the first applicator element, the receptacle including a perforated wall surrounding the second applicator element at least in part, and comprising at least one opening configured to enable the second applicator element to communicate with ambient air when the receptacle is closed.

2. A device according to claim 1, wherein the substance comprises a fluid.

3. A device according to claim 1, wherein the second applicator element does not come into contact with the first applicator element.

4. A device according to claim 1, wherein the receptacle comprises a housing that receives the first applicator element when the receptacle is closed.

5. A device according to claim 4, wherein the housing is in communication with the supply of substance.

6. A device according to claim 1, wherein the first applicator element comprises a flexible endpiece.

7. A device according to claim 6, wherein the endpiece is made of at least one of elastomer and foam.

8. A device according to claim 1, wherein the first applicator element comprises at least one cavity configured to retain the substance.

9. A device according to claim 1, wherein the first applicator element comprises a tube configured to be filled at least in part with the substance.

10. A device according to claim 9, wherein the tube is connected to a cavity of variable volume.

11. A device according to claim 10, wherein the cavity is defined at least in part by a flexible wall configured to be pressed by a user.

12. A device according to claim 1, wherein the first applicator element is secured to the receptacle during application.

13. A device according to claim 1, wherein the second applicator element is secured to a closure member for the receptacle.

14. A device according to claim 13, wherein the closure member is configured to co-operate with the receptacle to prevent communication between the second applicator element and the supply of the substance when the receptacle is closed.

15. A device according to claim 1, wherein the second applicator element comprises a foam.

16. a devise according to claim 15, wherein the foam is hollowed out centrally.

17. A device according to claim 1, wherein the second applicator element is compressible and is configured to prevent the first applicator element from coming into contact with the region being treated so long as the second applicator element is not compressed.

18. A device according to claim 1, wherein the first and second applicator elements are secured to each other in use.

19. A device according to claim 1, wherein the second applicator element surrounds the first applicator element at least in part, at least when applicator element comes into contact with the region to be treated.

20. A device according to claim 1, wherein the first and second applicator elements are disposed substantially on one side of the handle member, at least while each of the applicator elements is in use.

21. A method of applying makeup via a device as defined in claim 1, comprising:

filling the first applicator element with the substance from the receptacle;

releasing the substance on the first applicator element; and using the second applicator element to at least one of spread out and blend in the released substance on the region to be treated.

22. A method according to claim 21, wherein using the second applicator element comprises applying makeup to at least one of skin, lips, and nails.

23. A device for packaging and applying a substance, the device comprising:

a receptacle containing a supply of the substance;

a first applicator element configured to be filled with the substance from the receptacle; and a second applicator element secured to a closure member for the receptacle and configured to be separated from the receptacle, configured to come into contact with a region to be treated, and configured to at least one of spread out and blend in the substance from the first applicator element, said second applicator element surrounding the first applicator element at least in part, at least when the second applicator element is secured to the receptacle, wherein the substance comprises a powder.

24. A device for packaging and applying a substance, the device comprising:

a receptacle containing a supply of the substance;

a first applicator element configured to be filled with the substance from the receptacle; and a second applicator element secured to a closure member for the receptacle and configured to be separated from the receptacle, configured to come into contact with a region to be treated, and configured to at least one of spread out and blend in the substance from the first applicator element, said second applicator element surrounding the first applicator element at least in part, at least when the second applicator element is secured to the receptacle, wherein the first applicator element is configured to act as a piston in a housing of the receptacle while the second applicator element is being separated from the receptacle.

25. A device according to claim 24, wherein the receptacle comprises a dip tube in communication with the housing.

26. A device according to claim 24, wherein the first applicator element comprises a sealing lip configured to press against a wall of the housing.

27. A device according to claim 26, wherein the receptacle comprises an endpiece communicating with a dip tube, and in which the first applicator element is configured to engage in a substantially leaktight manner to suck up the substance from the receptacle.

28. A device according to claim 27, wherein the first applicator element and the endpiece are arranged to co-operate in a substantially leaktight manner before the closure member becomes fully secured to the receptacle.

29. A device according to claim 3, for packaging and applying a substance on at least one of skin, lips, and nails, the device comprising:

a receptacle containing a supply of the substance;

a first applicator element configured to be filled with the substance from the receptacle; and a second applicator element secured to a closure member for the receptacle and configured to be separated from the receptacle, configured to come into contact with a region to be treated, and configured to at least one of spread out and blend in the substance from the first applicator element, the first and second applicator elements being disposed substantially on one side of a handle member, at least while in use, wherein the second applicator element is in communication with ambient air when the receptacle is closed.

30. A device for packaging and applying a substance on at least one of skin, lips, and nails, the device comprising:

a receptacle containing a supply of the substance;

a first applicator element configured to be filled with the substance from the receptacle; and a second applicator element secured to a closure member for the receptacle and configured to be separated from the receptacle. configured to come into contact with a region to be treated, and configured to at least one of spread out and blend in the substance from the first applicator element, the first and second applicator elements being disposed substantially on one side of a handle member, at least while in use, wherein the receptacle comprises at least one passage configured to enable the second applicator element to communicate with ambient air when the receptacle is closed.

* * * * *